United States Patent [19]

Shmueli

[11] Patent Number: 4,518,165

[45] Date of Patent: May 21, 1985

[54] THREE DIMENSIONAL COMBINATION ASSEMBLY GAME

[76] Inventor: Shmuel S. Shmueli, 375 Queens Ct., Ridgewood, N.J. 07450

[21] Appl. No.: 493,585

[22] Filed: May 11, 1983

[51] Int. Cl.[3] ..... A63F 9/12

[52] U.S. Cl. ..... 273/156

[58] Field of Search ..... 273/156, 157 R, 160

[56] References Cited

U.S. PATENT DOCUMENTS

| | | | |
|---|---|---|---|
| 702,615 | 6/1902 | Barden | 273/157 R |
| 1,886,109 | 11/1932 | L'Enfant | 273/160 X |
| 3,565,443 | 2/1971 | Klein | 273/157 R |
| 4,040,630 | 8/1977 | Brattain | 273/157 R |

*Primary Examiner*—Anton O. Oechsle

[57] ABSTRACT

Three Dimensional Combination Assembly is a game in which the player has to disassemble parts and reassemble them back to the starting position. The parts are interchangeable and therefore many false assembly combinations are available, hence, the objective is to reassemble the game back to the starting position.

10 Claims, 9 Drawing Figures

THREE DIMENSIONAL COMBINATION ASSEMBLY GAME

BRIEF DESCRIPTION OF THE INVENTION WITH REFERENCE TO THE ACCOMPANYING DRAWINGS

FIG. 1*a* is a top plan view of the base;

FIG. 1*b* is side view of the base;

FIG. 2*a* is a side view of one of the segments;

FIG. 2*b* is a top plan view of the segment illustrated in FIG. 2*a;*

FIG. 3 is a top plan view of another segment;

FIG. 4, 5, and 6 are top plan views of the first, second and third levels of segments, respectively, correctly assembled on the base; and FIG. 7 is a perspective view of the game or puzzle correctly assembled.

DETAILED DESCRIPTION OF THE INVENTION

The invention consists of a cylindrical base 2 having six vertically disposed pins 1 extending upwardly therefrom. The pins are equidistantly disposed in a circular array having a fixed diameter hereinafter termed D. Nine cylindrical segments having radiused slots 4 of said D diameter are adapted to be assembled on the base over the pins, the top of each of which is provided with a lead angle 3 for the segments. The segments are of four types, A,B,C and D, and the slots in each of the segments can take the form of two rather short slots as illustrated in FIGS. 2–6 or a single elongated slot as illustrated in FIG. 7.

Nine segments are assembled in three levels, three in each level, over the pins (#1). (FIGS. 4, 5, 6.), When the segments are assembled correctly, grooves A1, A2, A3, and A4 will line up in all levels. (see FIG.-7, A2, A3)

If assembled incorrectly the grooves will not line up or will partially overhang each other, hence, the game is not solved. Of a total of nine segments there are four different types as follows:

1st Level (FIG.-4) One type B segment, one type C, and one type D.

2nd Level (FIG.-5) Two type A segments and one type B.

Figure 6:
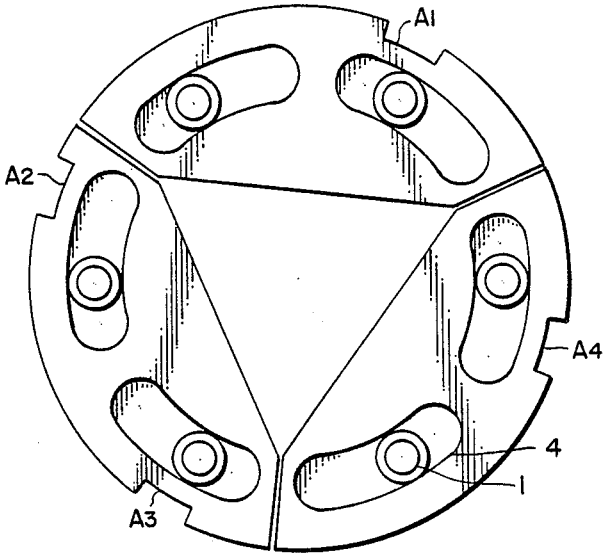
Figure 7:
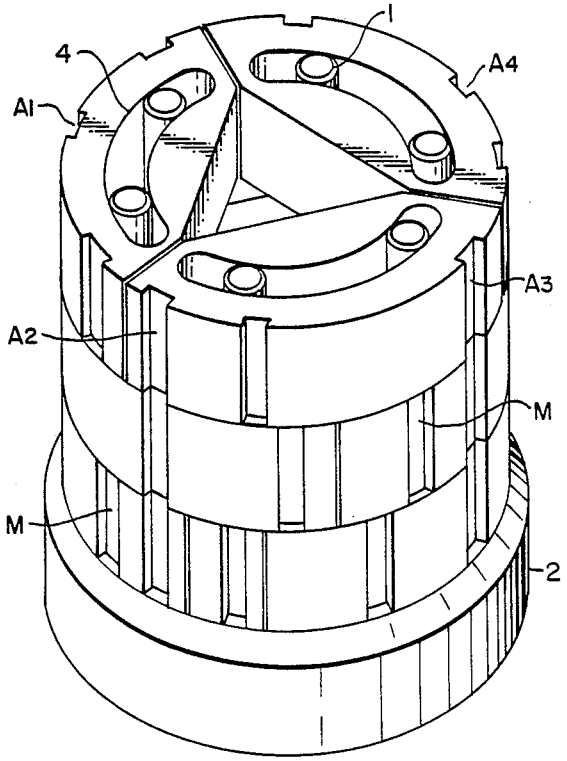

3rd Level (FIG.-6 Two type A segments and one type B. Total of four type A segments, three type B, one of C, and one of D.

Figure 1A:
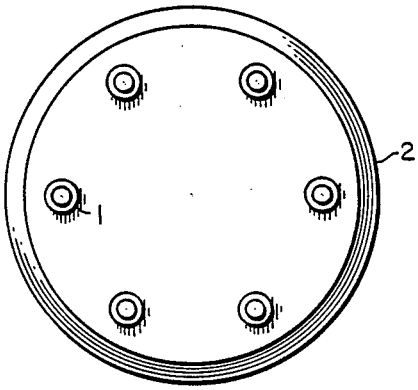
Figure 1B:
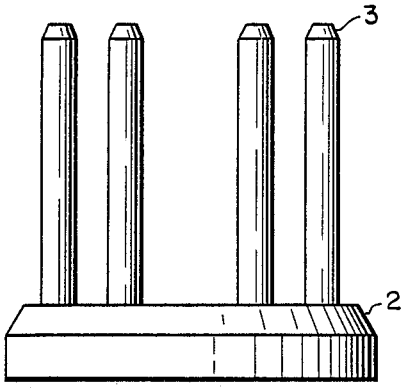
Figure 2A:
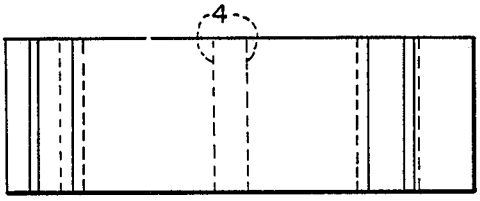
Figure 2B:
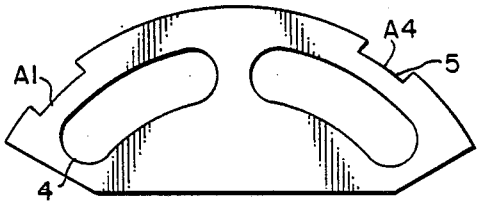
Figure 3:
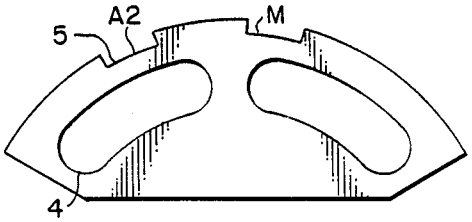
Figure 4:
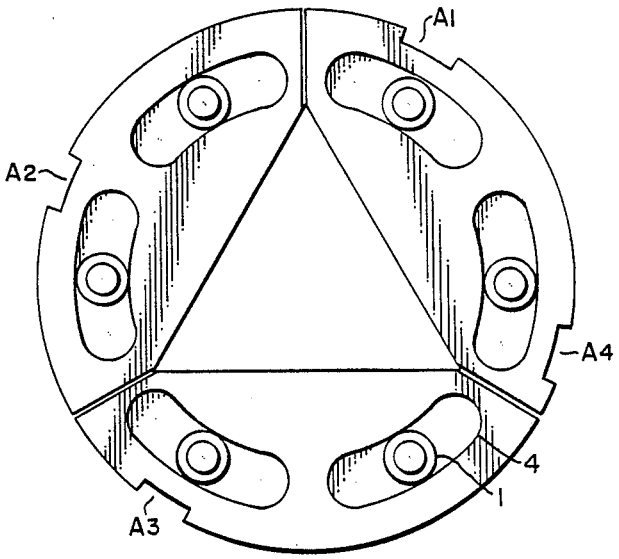
Figure 5:
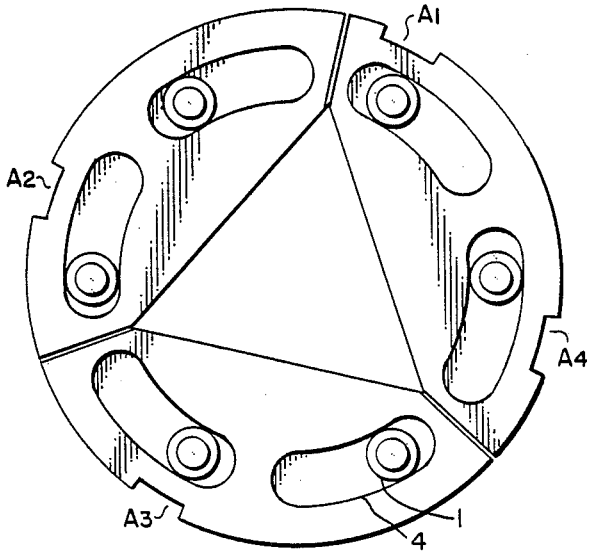

If a player misplaces one of the segments, say a type D segment with two type A segments, he will not be able to line up grooves A1, A2, A3, and A4, unless he tried again, in different positions. If a player places two segments correctly but reverses the third, there is no possibility to line up the grooves unless the misplaced segment is reversed. There are many combinations to try before one can line up the four grooves. To make it even harder, and to add many more combinations, it is possible to add misleading grooves. (see FIG.-3, type E). The groove marked M is not necessary to line up grooves A1, A2, A3, and A4, but by adding type M grooves there will be many more combinations, (see M grooves FIG.-7). The fit between the radiused slots (#4) and the pins (#1 FIG.-1), should be a slide fit. The grooves can be a different color than the basic segment color. The triangular space created after the three segments are assembled, is necessary for easy access while assembling and disassembling.

I claim:

1. A Three Dimentional Combination Assembly Game comprising:
   - A. A cylindrical base,
   - B. Six pins equally spaced on a D diameter which are part of said base,
   - C. Segments which have radiused slots on a D diameter,
   - D. One or more grooves on the outside surfaces of said segments.

2. The invention as defined in claim 1 wherein; said slotted segments are assembled three in each level.

3. The invention as defined in claim 1 wherein; said segments are interchangeable and each can be assembled in six different upright positions, and six different reversed positions, per each level.

4. The invention as defined in claim 1 wherein; each of said segments has one or more of said grooves.

5. The invention as defined in claim 1 wherein; said grooves are spaced differently on the outside surfaces of said segments.

6. The invention as defined in claim 1 wherein; each of said segments, when assembled on said pins, can be swiveled as long as there is clearance between said slots and pins.

7. The invention as defined in claim 1 wherein; assembly of three segments in one level will form a cylindrical contour.

8. The invention as defined in claim 1 wherein; said assembled segments form a space in the center of said cylindrical contour to allow easy assembly or disassembly of said segments.

9. The invention as defined in claim 1 wherein; said segments when assembled correctly will have four lined up grooves on said cylindrical contour.

10. The invention as defined in claim 1 wherein; said segments have misleading grooves on the outside surfaces thereof to increase combination possibilities.

* * * * *